United States Patent [19]

Kato

[11] Patent Number: 4,524,666

[45] Date of Patent: Jun. 25, 1985

[54] MUSICAL TONE FORMING SYSTEM

[75] Inventor: Mitsumi Kato, Hamamatsu, Japan

[73] Assignee: Nippon Gakki Seizo Kabushiki Kaisha, Hammatsui, Japan

[21] Appl. No.: 531,437

[22] Filed: Sep. 12, 1983

[30] Foreign Application Priority Data

Sep. 14, 1982 [JP] Japan ..... 57-160277

[51] Int. Cl.[3] ..... G10H 1/02; G10H 1/40; G10H 7/00

[52] U.S. Cl. ..... 84/1.03; 84/1.26; 84/DIG. 12

[58] Field of Search ..... 84/1.13, 1.26, 1.03, 84/DIG. 12

[56] References Cited

U.S. PATENT DOCUMENTS 4,189,970 2/1980 Woron ..... 84/1.26 X
4,336,736 6/1982 Mishima ..... 84/1.26
4,442,745 4/1984 Gross et al. ..... 84/1.26 X

*Primary Examiner*—S. J. Witkowski
*Attorney, Agent, or Firm*—Spensley, Horn, Jubas & Lubitz

[57] ABSTRACT

A musical tone forming system includes a waveform storage device for storing data representative of an attack portion of a musical tone waveform and data representative of part of the other portion of the musical tone waveform following the attack portion. An address device addresses the waveform storage device to first read the data representative of the attack portion and to then repeatedly read the part of the waveform from the waveform storage device to thereby form a musical tone signal. There is provided a device for generating data varying with time. The address device feeds an address data to the waveform storage device in accordance with the time-varying data to randomly designate as a starting address one of those addresses of the waveform storage device storing the data of the part of the waveform, thereby realizing a noisy nature characteristic of a percussion instrument.

4 Claims, 10 Drawing Figures

MUSICAL TONE FORMING SYSTEM

BACKGROUND OF THE INVENTION

1. Field of the Invention

This invention relates generally to electronic musical instruments and particularly to a musical tone forming system of the type in which data representative of a musical tone waveform is read out from a waveform storage means to form a required musical tone.

2. Prior Art

There has been proposed one conventional musical tone forming system in which data representing full waveforms of predetermined musical tones is read from an associated waveform storage means to produce musical tone signals. With this conventional system, there can be produced musical tones very close to those produced by a non-electronic or acoustic musical instrument, and particularly this system is suitable for producing percussive tones. This conventional system has been found disadvantageous, however, in that the waveform storage means must have a large capacity for storing the data representative of the full musical tone waveforms. This increases the manufacturing cost of the system.

In order to overcome this disadvantage, another conventional musical tone forming system has been proposed in which an attack or initial portion of each musical tone waveform which has a relatively complicated shape is fully stored in the waveform storage means while part (for example, one cycle) of the other portion of the musical tone waveform is stored in the waveform storage means, the other portion having a less complicated shape. With this arangement, the data representative of the full attack portion is first read out from the storage means and then the data representing the aforesaid part of the other portion is repeatedly read out from the waveform storage means so as to form a musical tone signal representative of a required musical tone. Thus, since the data representative of the aforesaid part is repeatedly used to determine the other portion of the musical tone waveform other than the attack portion, the produced musical tone is inevitably different in nature from that produced by the acoustic musical instrument. Particularly, when a noisy percussive musical tone such as that produced by a cymbal is produced with this conventional system, the resultant musical tone does not accurately exhibit a noisy nature characteristic of such a percussive sound because the same waveform, i.e., the aforesaid part, is successively repeated to provide the other portion of the musical tone waveform following the attack portion.

SUMMARY OF THE INVENTION

It is therefore an object of this invention to provide a musical tone forming system which has waveform storage means of a relatively small capacity and is capable of producing musical tones close in nature to those produced by a conventional non-electronic musical instrument.

According to the present invention, there is provided a musical tone forming system comprising:

(a) waveform storage means for storing data representative of an attack portion of a musical tone waveform and data representative of part of the other portion of the musical tone waveform following the attack portion;

(b) means for generating data varying with time; and (c) address means for addressing the waveform storage means to first read the data representative of the attack portion and to then repeatedly read the part from the waveform storage means to thereby forming a musical tone signal, the address means feeding an address data to the waveform storage means in accordance with the time-varing data to randomly designate as a starting address one of those addresses of the waveform storage means storing the data of the part.

DESCRIPTION OF THE PREFERRED EMBODIMENTS OF THE INVENTION

Figure 1:
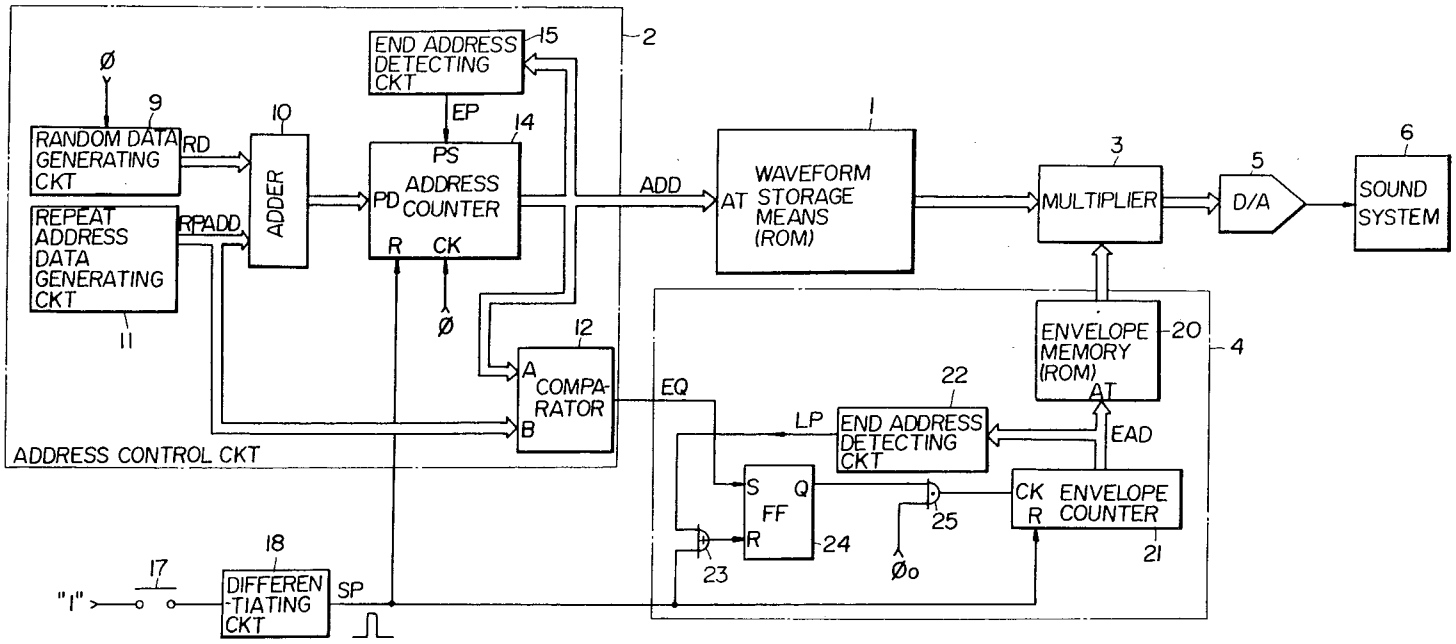
FIG. 1 is a block diagram of a circuitry of a musical tone forming system provided in accordance with the present invention.

FIG. 1 is a block diagram of a musical tone forming system according to the present invention. Data representative of a full attack portion of waveforms of predetermined musical tones and data representative of one cycle of the other portion following the attack portion are stored in waveform storage means 1 such as a read only memory (ROM). More specifically, with reference to FIG. 2A illustrating a waveform of such a musical tone, preselected instantaneous values of the attack portion A are converted into digital data which in turn are stored in the waveform storage means 1 consecutively from address 0. Also, preselected instantaneous values of part or a first cycle of the other portion following the attack portion A are converted into digital data which in turn are stored successively in those addresses or locations of the waveform storage means 1 following the address in which the last instantaneous value of the attack portion A is stored. This one cycle portion is designated by B in FIG. 2A. The address of the waveform storage means 1 in which the data representing the first instantaneous value $P_2$ of the portion B is stored is hereinafter referred to as repeat address RPAD while the address in which the last instantaneous value $P_3$ of the portion B is stored is hereinafter referred to as end address ENAD. As described above, the first instantaneous value $P_1$ of the attack portion A is stored in the address 0 of the waveform storage means 1.

The waveform data are sequentially read from the waveform storage means 1 in accordance with address data fed from an address control circuit 2 and then are sent to a multiplier 3. In this case, the data representative of the instantaneous values of the attack portion A are sequentially read from the waveform storage means 1, and then the data representative of the instantaneous values of the portion B are repetitively read therefrom. An envelope generator 4 feeds envelope data ED to the multiplier 3 in which each data from the waveform storage means 1 is multiplied by the envelope data ED, and the multiplier 3 feeds output data representative of the result of this multiplication to a digital-to-analogue converter 5. During the period of time when the data representative of the attack portion A are fed from the waveform storage means 1, the envelope generator 4 feeds the envelope data ED representative of 1. On the other hand, during the period of time when the waveform storage means 1 repetitively outputs the data representative of the portion B, the value of the envelope data ED outputted from the envelope generator 4 is sequentially reduced to 0.9, 0.85 and so on. In other words, by means of the envelope generator 4 and the multiplier 3, an envelope is applied to that portion of the musical tone signal following the attack portion A. The digital-to-analogue converter 5 converts each output data from the multiplier 3 into an analogue signal which in turn is applied to a sound system 6 for producing a musical sound.

The address control circuit 2 and the envelope generator 4 will now be described in more detail. The address control circuit 2 comprises a random data generating circuit 9, and an adder 10, a repeat address data generating circuit 11, a comparator 12, an address counter 14 and an end address detecting circuit 15. The random data generating circuit 9 of the conventional type produces a random data RD which varies randomly each time a clock pulse Ø is applied to the random data generating circuit 9, and the random data is applied to one input terminal of the adder 10. The repeat address data generating circuit 11 produces a repeat address data RPADD representative of the above-mentioned repeat address RPAD at all times when the system is in operation, the circuit 11 comprising a digital switching circuit, a read only memory or the like. The repeat address data RPADD is applied to the other input terminal of the adder 10 and also to an input terminal B of the comparator 12. The adder 10 serves to add the random data RD to the repeat address data RPADD and applies an output data representative of this addition result to a preset data terminal PD of the address counter 14. The address counter 14 functions to count up clock pulses applied to its clock terminal CK. Upon application of a pulse signal to a preset terminal PS of the address counter 14, the output data of the adder 10 is loaded onto the address counter 14 while upon application of a pulse signal to a reset terminal R of the address counter 14, the contents of the address counter 14 are cleared. The address counter 14 feeds address data ADD representative of the counted-up pulses to an address terminal AT of the waveform storage means 1, an input terminal of the end address detecting circuit 15 and an input terminal A of the comparator 12. When the address counter 14 outputs the address data ADD representative of the above-mentioned end address ENAD, the end address detecting circuit 15 outputs an end pulse EP to the preset terminal PS of the address counter 14. The comparator 12 functions to compare the address data ADD applied to its input terminal A with the repeat address data RPADD applied to its input terminal B, and outputs a coincidence signal EQ to the envelope generator 4 when the two data ADD and RPADD coincide with each other.

The operation of the address control circuit 2 will now be described. First, upon actuation of a tone-generating command switch 17 shown in FIG. 1, a differentiating circuit 18 outputs a starting pulse SP to the reset terminal R of the address counter 14 whereupon the address counter 14 is reset. Subsequently, the address counter 14 counts up clock pulses Ø applied to its clock terminal CK, so that the address counter sequentially outputs count values 0, 1, 2 . . . as the address data ADD to the waveform storage means 1. In response to these address data, the data representing the instantaneous values of the attack portion A of the musical tone waveform are sequentially read from the waveform storage means 1, and then the data representing the instantaneous values of the portion B of the musical tone waveform are sequentially read from the waveform storage means 1. Then, when the address counter 14 outputs the address data ADD representative of the end address ENAD, the end address detecting circuit 15 outputs the end pulse EP to the preset terminal PS of the address counter 14, so that the output data from the adder 10 is loaded onto the address counter 14. In this case, the output data of the adder 10 is the sum of the repeat address data RPADD and the random data RD. Therefore, the data loaded onto the address counter 14 is slightly either greater or less than the repeat address data RPADD although in some cases the former is equal to the latter. The random data RD is predetermined to vary within such a range that the output data of the adder 10 does not become greater than the end address data. Then, the data loaded onto the address counter 14 is fed to the waveform storage means 1 as the address data ADD. Then, the address counter 14 again counts up the clock pulses Ø, so that the waveform data stored in the address corresponding to the loaded data (the sum of the random data and the repeat address data) to the end address ENAD are sequentially read therefrom. When the address data ADD reaches a value corresponding to the end address ENAD, the end address detecting circuit 15 again outputs the end pulse EP to the preset terminal PS of the address counter 14, so that the output data of the adder 10 is again loaded onto the address counter 14. Thereafter, the above-mentioned operation is repeated.

Thus, in the circuitry shown in FIG. 1, each time the data representing the portion B of the musical tone waveform is read from the waveform storage means 1, the address data ADD is slightly changed by adding the random data, which varies with time, to the repeat address data RPADD. With this method, the portion B varies in shape each time the data representing it is read from the waveform storage means 1. Therefore, the resultant musical tone signal is not periodic, so that the musical sound generated from the sound system 6 is very close to that produced by the non-electronic conventional musical instrument.

The adder 10 shown in FIG. 1 may be replaced by a multiplier. Also, the random data generating circuit 9 may be replaced by a suitable circuit for generating periodic data of which period should be sufficiently longer than the period of the reading-out of the waveform data representative of the portion B. Further, the adder 10 and the repeat address data generating circuit 11 may be replaced by a memory device storing the repeat address RPAD and the addresses adjacent thereto. This memory device is addressed by either the random data RD or periodic data so that the data read therefrom is applied to the preset data terminal PD of the address counter 14.

The envelope generator 4 will now be described. An envelope memory 20 is a read only memory (ROM) storing envelope data ED whose value sequentially reduces such as "1", "0.9", "0.85" . . . "0" are stored from address 0. The envelope data ED are read from the envelope memory 20 in accordance with address data EAD applied to an address terminal AT of the envelope memory 20 from an envelope counter 21, and the readout envelope data ED is applied to the multiplier 3. Data of the value 0 is stored in each of those addresses of the envelope memory 20 running from the address storing the envelope data ED representative of 0 up to the largest or end address represented by binary code "11 . . . 11". An end address detecting circuit 22 is responsive to the end address data "11 . . . 11" from the envelope counter 21 to output a detecting pulse signal LP.

Next, the operation of the envelope generator 4 will now be described. First, the differentiating circuit 18 feeds a starting pulse signal SP to a reset terminal R of a flip-flop 24 FF via an OR gate 23. The starting pulse signal SP is also applied to a reset terminal R of the envelope counter 21. Upon application of the starting pulse signal SP to the reset terminal R of the flip-flop 24, the flip-flop 24 is reset so that "0" signal is outputted from its output terminal Q to close an AND gate 25. Upon application of the starting pulse SP to the reset terminal R of the envelope counter 21, the envelope counter 21 is reset so that its count output is rendered 0. This count output of the value 0 is applied to the envelope memory 20 as the address data EAD so that the envelope data ED representative of 1 is read from the address 0 of the envelope memory 20 and applied to the multiplier 3. This condition is maintained until the comparator 12 feeds the coincidence signal EQ to a set terminal S of the flip-flop 24. During this operation, the data representative of the attack portion A is read from the waveform storage means 1, as described above. Then, the address counter 14 feeds the address data ADD corresponding to the repeat address RPAD in response to which the comparator 12 outputs the coincidence signal EQ to the set terminal S of the flip-flop 24 whereupon the flip-flop 24 is set to feed "1" signal from its output terminal Q to the AND gate 25 to enable it. When the AND gate is in its enabled state, clock pulses $\emptyset_o$ are applied to the clock terminal CK of the envelope counter 21 through the AND gate 25. The clock pulse $\emptyset_o$ has a period much longer than the period of the clock pulse $\emptyset$. Upon application of the clock pulse $\emptyset_o$ to the clock terminal CK of the envelope counter 21, this counter counts up the clock pulses $\emptyset_o$, so that the value of the address data EAD are sequentially changed to 1, 2 and so on. As a result, the value of the envelope data Ed representing 0.9, 0.85 . . . are read sequentially from the addresses 1,2 . . . of the envelope memory 20 and are applied to the multiplier 3. When the envelope data ED representative of 0 is read from the envelope memory 20, the output of the multiplier 3 is rendered 0 to stop the generation of the musical tone. Subsequently, the envelope counter 21 further counts up the clock pulses and when the end address data EAD representative of "11 . . . 11" is outputted from the envelope counter 21, the end address detecting circuit 22 detects this end address data and applies the detecting signal LP to the reset terminal R of the flip-flop 24 via the OR gate 23. As a result, the flip-flop 24 is reset and the AND gate 25 is closed. When the AND gate 25 is closed, the supply of the clock pulse $\emptyset_o$ to the clock terminal CK of the envelope counter 21 is stopped, so that the envelope counter 21 stops its counting operation. Thereafter, the envelope counter 21 successively supplies the end address data EAD representative of "11 . . . 11". As described above, the end address of the envelope memory 20 stores "0", and therefore the interruption of generation of the musical tone is maintained thereafter. Then, when the tone generating command switch 17 is again operated, the generation of the musical tone is commenced.

The foregoing is a detailed description of the circuitry shown in FIG. 1. This circuitry is capable of generating only one kind of musical tone. In the case where it is desired to generate a plurality of musical tones, circuitries corresponding in number to the plurality of musical tones and similar to the circuitry shown in FIG. 1 are provided, and digital-to-analogue converters similar to the converter 5 and associated respectively with the circuitries are provided. The outputs from these converters are mixed by one sound system 6 to generate a plural kinds of musical tones.

The musical tone generating circuitry shown in FIG. 1 is well suited for producing a percussive tone such as those produced by a cymbal, a bass drum and so on, but it can of course generate a musical tone other than such a percussive tone. For example, in the case where it is desired to generate a piano sound, data representative of waveforms of a piano tone are stored in the waveform storage means 1, and these data are selectively read from the waveform storage means 1 in accordance with depressed keys of the piano keyboard. In this case, circuitries similar to the circuitry shown in FIG. 1 and corresponding respectively to the keys of the piano keyboard are provided, and data representative of waveforms of pitches of these keys are stored in the respective waveform storage means 1. Alternatively, the circuitry shown in FIG. 1 may be used for all the keys, and the frequency of the clock pulse $\emptyset$ applied to the address counter 14 may be changed in accordance with the pitch of each depressed key.

Figure 3:
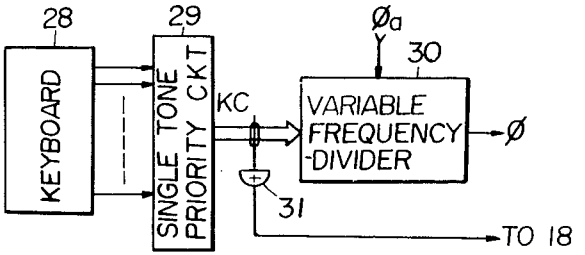
FIG. 3 is a block diagram of an additional circuitry for use with the system of FIG. 1 for forming a keyboard musical tone.

FIG. 3 shows a block diagram of an additional circuit adapted to be used together with the circuitry shown in FIG. 1. In FIG. 3, a keyboard 28 is provided with key operation-detecting switches corresponding to keys of the keyboard 28. The output of each switch is applied to a single tone priority circuit 29. The priority circuit 29 detects the highest note key (or the lowest note key) among simultaneously depressed keys in accordance with the outputs from key operation-detecting switches associated with these depressed keys so that it outputs data, representative of a key code KC of the detected key, to a variable frequency divider 30. The variable frequency-divider 30 functions to divide the frequency of a clock pulse $\emptyset_a$ in accordance with the data representative of the key code KC to feed a clock pulse $\emptyset$, corresponding to the key code KC, to the clock terminal CK of the address counter 14 shown in FIG. 1. An OR gate 31 logically adds bits of the output of the priority circuit 29 and detects the data representative of any key code KC outputted from the priority circuit 29. The output of the OR gate 31 is connected to an input terminal of the differentiating circuit 18 so that at the leading edge of the output of the OR gate 31, the differentiating circuit 18 supplies the starting pulse SP.

Figure 2B:
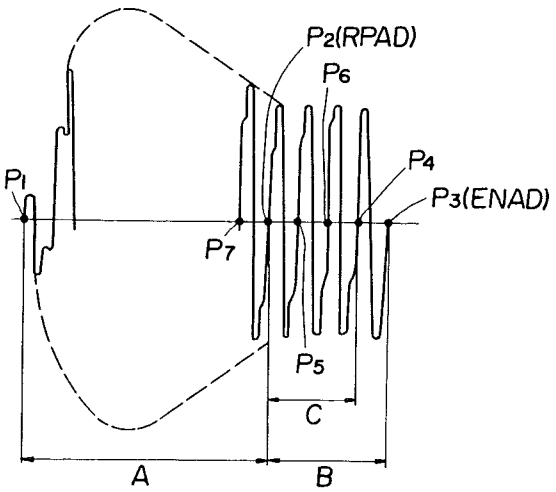
FIG. 2B is a diagrammatical illustration showing another musical tone waveform.
Figure 2A:
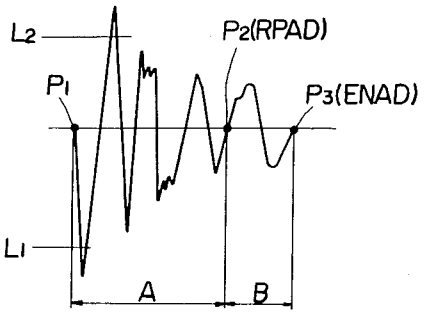
FIG. 2A is a diagrammatical illustration showing a waveform of a musical tone.

In this case, as shown in FIG. 2B, instead of the one cycle (FIG. 2A), the portion B of the musical tone waveform may be composed of a plurality of cycles, for example, four consecutive cycles of the musical tone waveform following the attack portion A are preferably stored in the waveform storage means 1. Also, the maximum positive value of the random data RD is determined to be below a value obtained by the subtraction of the address data representative of point $P_2$ from the address data representative of point $P_4$ (see C in FIG. 2B), so that when data representing the portion B is repeatedly read from the waveform storage means 1, at least one cycle of the portion B is necessarily read out. The reason for this is as follows: In the case where data representative of piano tones are stored in the waveform storage means 1, it is necessary that the waveform represented by the data read from the storage means 1 should have predetermined pitches. In this case, if at the time of reading the data representative of the portion B from the storage means 1 the output data from the adder 10 represents the address data corresponding to a midway point of the final cycle of the portion B, then the waveform represented by the read-out data has less than one cycle. If the waveform of such a shape is successively read out, the resultant musical tone is unstable in pitch.

In order to improve the continuity of the repeatedly read waveforms of the portion B, the output data of the adder 10 may designate one of the addresses storing data representing amplitude values 0 of the portion B (more preferably, the addresses storing data representing amplitude values changing from minus to plus). More specifically, the output data of the adder 10 designates any one of the addresses storing data representing points $P_2$, $P_5$, $P_6$, $P_4$, $P_7$ . . . (FIG. 2B). To achieve this, instead of the adder 10 and the repeat address data generating circuit 11, a read only memory (ROM) storing data representing the address number of the points $P_2$, $P_5$, $P_6$, $P_4$, $P_7$ . . . is connected between the random data generating circuit 9 and the address counter 14, so that this ROM is addressed by the random data RD to feed an output data to the present terminal PD of the address counter 14. In this case, the comparator 12 is replaced by a repeat address detecting circuit similar to the end address detecting circuit 15.

In the circuit shown in FIG. 1, when the waveforms of musical tones are stored in the waveform storage means 1, it is preferred that the portions of the waveform having relatively large amplitudes, such as the attack portion is stored in the storage means in a clipped manner. For example, as shown in FIG. 2A, the portions below level $L_1$ and above level $L_2$ are stored in the storage means 1. The reason for this is that when the waveform having a relatively large amplitude is stored, the number of bits representing the waveform data becomes larger. And, when it is intended not to increase the number of bits, a resolution of those portions of the waveform having a small amplitude is adversely affected. The degree of clipping of the waveform is determined by the number of bits of the data and the fidelity of the musical tone to be reproduced. Such clipping may also be used with respect to the repetition portion, i.e., the portion B in FIGS. 2A and 2B.

Further, in the circuit shown in FIG. 1, the generation of the musical tone is stopped by maintaining the count output of the envelope counter 21 at the end address data representative of "11 . . . 11". This may be also done by forcibly maintaining the count output of the address counter 14 at 0. The data stored in the address 0 of the waveform storage means 1 is 0.

Figure 4:
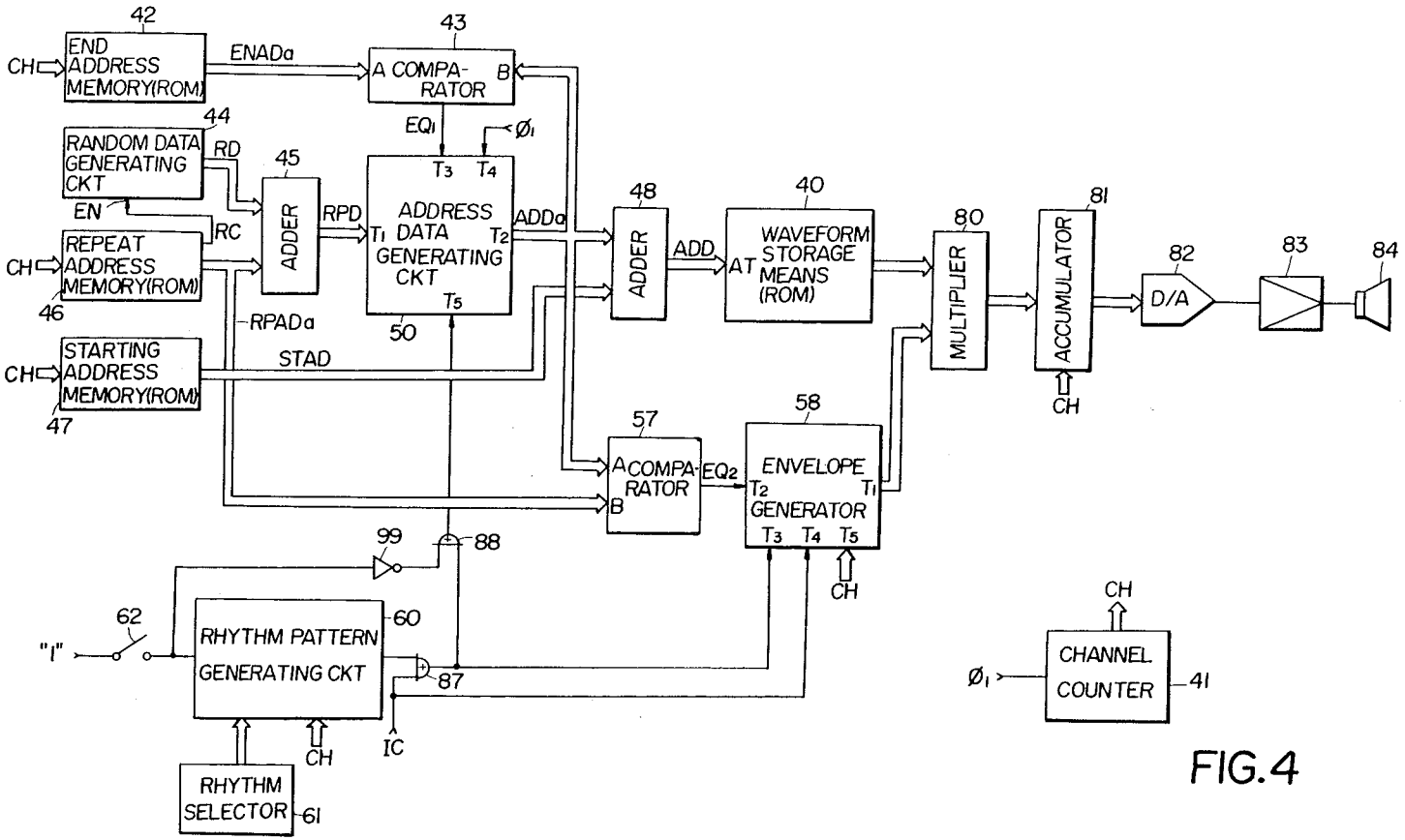
FIG. 4 is a block diagram of a circuitry of an another musical tone forming system.

FIG. 4 is a block diagram of modified musical tone forming system in the form of an electronic musical instrument capable of generating eight kinds of rhythmic sounds. This musical instrument comprises waveform storage means 40 in which data representing eight kinds of musical tones are stored. With this arrangement, associated circuits of the musical instrument are operated in a time-sharing manner to generate eight kinds of rhythmic tones simultaneously. A fundamental principle of the formation of musical tone is similar to that of the circuitry in FIG. 1.

In FIG. 4, a channel counter 41 is a binary three-stage counter for counting up clock pulses $\emptyset_1$, and the output of this counter which varies in the range between 0 to 7 is applied to the associated circuits as a channel signal CH. The values 0 to 7 of the channel signal CH correspond to the following rhythmic tones, respectively:

| | | |
|---|---|---|
| 0: maracas tone (low) | 1: conga tone (high) | 2: conga tone |
| 3: tom-tom tone | 4: bongo tone | 5: bass drum tone |
| 6: cymbal tone (No. 1) | 7: cymbal tone (No. 2) | |

The associated circuits are operated in accordance with the values of the channel signal CH to form the respective rhythmic tones.

Figure 5:
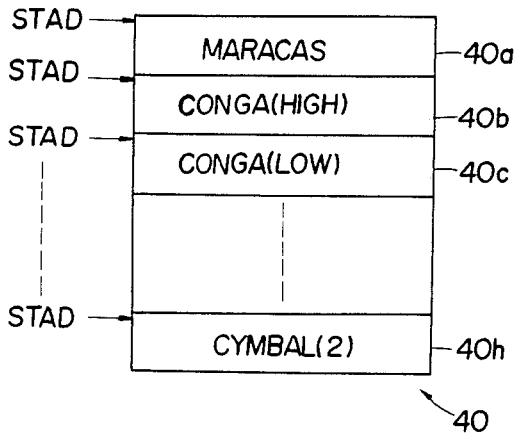
FIG. 5 is an illustration showing waveform storage means of the system of FIG. 4.

For example, as shown in FIG. 5, the waveform storage means 40 comprises a ROM having eight areas 40*a* to 40*h* in which data representative of the eight kinds of musical tone waveforms are stored, respectively. In this case, the data, representing the attack portion A of each musical tone waveform and the portion B following it (see FIGS. 2A and 2B), are stored in a respective one of the eight areas 40*a* to 40*h* of the waveform storage means 40 from its smallest address (hereinafter referred to as "starting address STAD" of each area) as is the case with the waveform storage means 1 in FIG. 1.

An end address memory 42 comprises a ROM storing data representative of relative end addresses ENADa of the eight kinds of waveforms stored in the waveform storage means 40. Each relative end address is a value obtained by subtracting the starting address STAD from the actual end address ENAD of each musical tone waveform, i.e., the end address of each area 40*a* to 40*h* of the waveform storage means 40. The memory 42 is addressed by the channel signal CH to output data representative of the selected relative end address ENADa to an input terminal A of a comparator 43.

A random data generating circuit 44 is substantially similar in construction to the random data generating circuit 9 shown in FIG. 1 and differs from it in that the former has an enabling terminal EN. When "1" signal is applied to the enabling terminal EN, the random data RD is outputted from the random data generating circuit 44 to one input terminal of an adder 45. When "0" signal is applied to the enabling terminal EN, the data representative of 0 is outputted to the adder 45.

A repeat address memory 46 comprises a ROM storing data representative of relative repeat addresses RPADa of the eight kinds of waveforms stored in the waveform storage means 40. Each relative repeat address RPADa is a value obtained by subtracting the starting address STAD from the actual repeat address RPAD of each musical tone waveform. The memory 46 is addressed by the channel signal CH to output data representative of the selected relative repeat address RPADa to the other input terminal of the adder 45 and an input terminal B of the comparator 57. The memory 46 also stores control data which represents "1" or "0" in accordance with the rhythmic tones, the control data RC being used to control the random data generating circuit 44. The control data RC is read from the memory 46 in accordance with the channel signal CH and is applied to the enabling terminal EN of the random data generating circuit 44. The generation of the random data RD is desired with respect to some rhythmic tones and is not desired with respect to the others. This is the reason why the control data RC should be provided. For example, in the case of the cymbal tone, the control data RC represent "1", and the random data RD is outputted from the random data generating circuit 44.

A starting address memory 47 comprises a ROM storing data representative of the starting addresses STAD of the musical tone waveforms stored in the waveform storage means 40. The starting address memory 47 is addressed by the channel signal CH to output a selected starting address data to an input terminal of an adder 48.

The adder 45 functions to add the output of the random data generating circuit 44 to the relative repeat address (RPADa) data and outputs repeat address data RPD representative of the result of this addition to an input terminal $T_1$ of an address data generating circuit 50.

Figure 6:
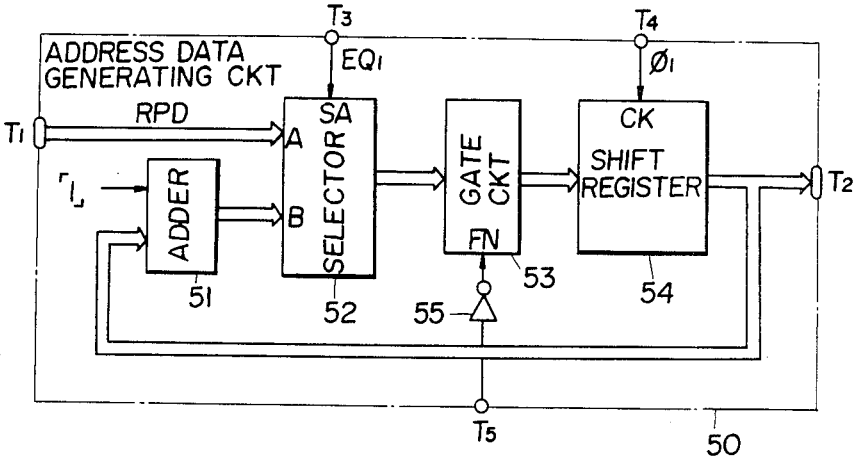
FIG. 6 is a block diagram of an address data generating circuit of the system of FIG. 4.

The address data generating circuit 50 corresponds to the address counter 14 shown in FIG. 1 and comprises an adder 51, a selector 52, a gate circuit 53, a shift register 54 and an inverter 55, as shown in FIG. 6. The adder 51 adds 1 to the output of the shift register 54. The selector 52 selects one of the data applied to its terminal A and its terminal B in accordance with a signal applied to its selector terminal SA, and outputs the selected data. The gate circuit 53 is opened when "1" signal is applied to its enabling terminal EN, and also is closed when "0" signal is applied to its enabling terminal EN. The shift register 54 is an eight-stage shift register in which data in each stage is shifted by a clock pulse $\emptyset_1$. The shift register 54 outputs address data ADDa from its terminal $T_2$ to the input terminal B of the comparator 43, the input terminal of the adder 48 and an input terminal A of the comparator 57.

The comparator 43 compares the relative end address (ENADa) data with the address data ADDa, and outputs a coincidence signal $EQ_1$ to an input terminal $T_3$ of the address data generating circuit 50 when the two data coincide with each other. The adder 48 adds the address data ADDa to the starting address (STAD) data and outputs address data ADD representative of the result of this addition to an address terminal AT of the waveform storage means 40. The comparator 57 compares the address data ADDa with the relative repeat address (RPADa) data, and outputs a coincidence signal $EQ_2$ to an envelope generator 58 when the two data coincide with each other. A rhythm pattern generating circuit 60 generates eight kinds of rhythm pulses corresponding respectively to the eight kinds of rhythmic tones. The pattern of each rhythm pulse is determined by the kind of rhythm selected by the rhythm selector 61, such as waltz, rumba and mambo. Each rhythm pulse is generated by turning on a rhythm switch 62, and the generation of the rhythm pulse is stopped by turning off the rhythm switch 62. Each rhythm pulse so generated is outputted from the rhythm pattern generating circuit 60 in a time-sharing manner in accordance with the channel signal CH. More specifically, as described above, in accordance with the values 0 to 7 of the channel signal CH, the rhythm pulses representing the eight rhythmic tones are outputted from the rhythm pattern generating circuit 60, respectively.

Figure 7:
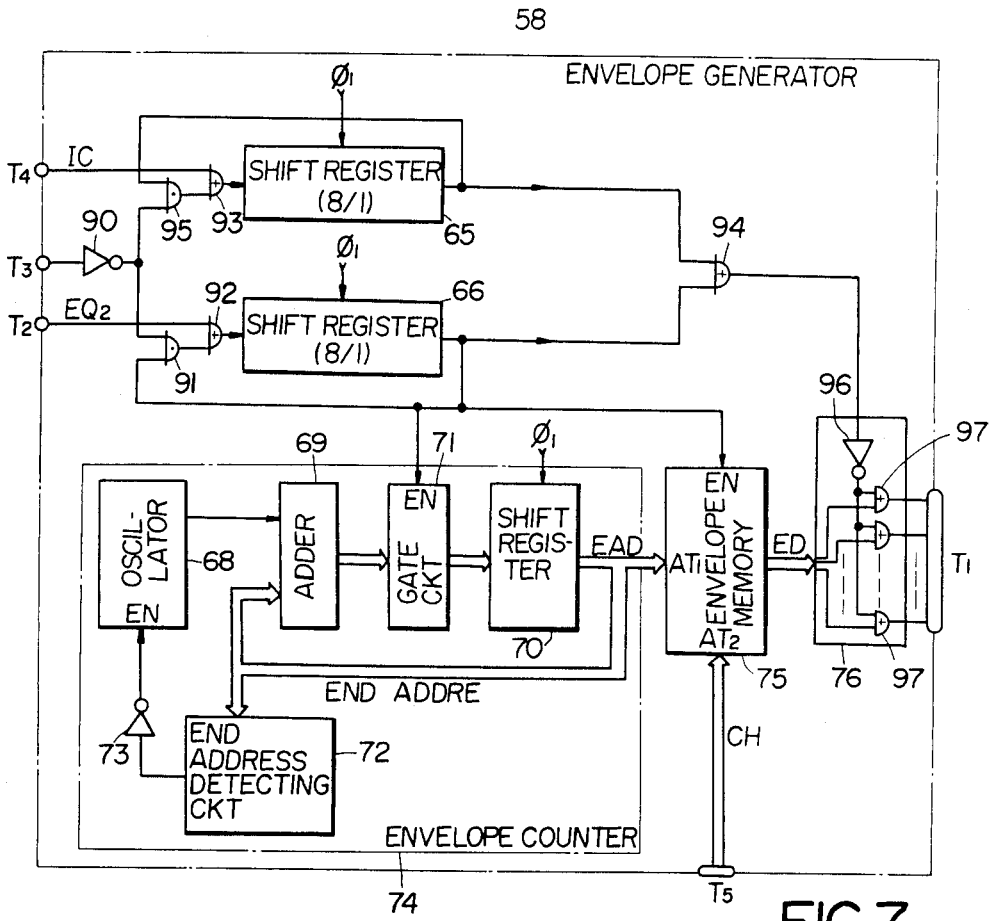
FIG. 7 is a block diagram of an envelope generator of the system of FIG. 4.
Figure 8:
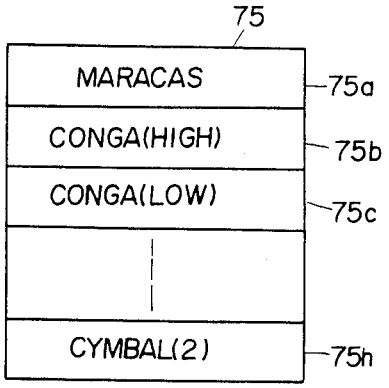
FIG. 8 is an illustration showing an envelope memory of the system of FIG. 4.

The envelope generator 58 corresponds to the envelope generator 4 in FIG. 1 and will now be described in detail with reference to FIG. 7. Reference numerals 65 and 66 designate eight-stage one bit shift registeres in which data in each stage is shifted by a clock pulse $\emptyset_1$. An oscillator 68 generates a pulse signal ("1" signal) having a pulse width of $8\emptyset_1$ and a period of $8\emptyset \times n$. When "1" signal is being applied to an enabling terminal EN of the oscillator 68, it outputs the pulse signal to a LSB terminal of one input terminal of an adder 69. When "0" signal is being applied to the enabling terminal EN, the oscillator 68 outputs "0" signal. The adder 69 adds the output of a shift register 70 to the output of the oscillator 68 and feeds an output to the shift register 70 via a gate circuit 71. The terminals of the one input terminal of the adder 69 other than the LSB terminal are grounded. In other words, when the output of the oscillator 68 is "1" signal, the adder 69 adds data representative of 1 to the output of the shift register 70. When the output of the oscillator 68 is "0" signal, the adder 69 adds data representative of 0 to the output of the shift register 70. The shift register 70 is of such a type that the data in each stage is shifted by a clock pulse $\emptyset_1$, and this shift register outputs address data EAD to an address terminal $AT_1$ of an envelope memory 75, the other input terminal of the adder 69 and an end address detecting circuit 72. The end address detecting circuit 72 is responsive to the output data of the shift register 70 representative of "11 . . . 11" and outputs "1" signal to an input terminal of an inverter 73. Thus, the above-mentioned component parts of the musical instrument constitutes an envelope counter 74 which is operated in a time-sharing manner. This envelope counter 74 corresponds to the envelope counter 21 in FIG. 1.

The envelope memory 75 (ROM) corresponds to the envelope memory 20 in FIG. 1 and has eight areas **75*a* to 75*h* in which envelope data ED corresponding respectively to the eight kinds of rhythm tones are stored. In this case, the maximum value 1 of the envelope data ED is stored in the starting address of each of the areas 75*a* to 75*h*, and the envelope data ED stored in each of the areas 75*a* to 75*h* is reduced gradually from the starting address. Also, data representative of 0 is stored in the end address of each of the areas 75*a* to 75*h*. The envelope memory 75 is addressed by both address data EAd applied to its address terminal $AT_1$ and the channel signal CH applied to its address terminal $AT_2$. In other words, the channel signal CH designates one of the areas 75*a* to 75*h*, and the address data EAD designates one of the addresses of each area 75*a* to 75*h*. For example, when the channel signal CH represents 3 and when the address data EAD represents 0, the starting address of the area 75*d* is designated. The envelope data ED so read out through the above-mentioned addressing is applied to an input terminal of a multiplier 80 (FIG. 4) through an OR gate circuit 76 and a terminal $T_1$. When "1" signal is being applied to the enabling terminal EN of the envelope memory 75**, the envelope data is read therefrom. And, when "0" signal is being applied to the enabling terminal EN, the data representative of 0 is outputted therefrom.

The multiplier 80 multiplies the output of the waveform storage means 40 by the output of the envelope generator 58 and feeds an output representative of the result of this multiplication to an accumulator 81. The accumulator 81 sequentially accumulates the outputs of the multiplier 80 during a period of time when the channel signal CH varies from 0 to 7, and latches the result of this accumulation and outputs the latched data to a digital-to-analogue converter 82. Then, the contents of the accumulator 81 is cleared. Then, this operation is repeated. The digital-to-analogue converter 82 converts the output of the accumulator 81 into an analogue signal and feeds it to a speaker 84 via an amplifier 83.

The operation of the circuitry in FIGS. 4 to 8 will now be described.

When a power source (not shown) for the circuitry is turned on, the clock pulses $\emptyset_1$ are applied to the relevant circuits, an initial clear circuit (not shown) outputs an initial clear signal IC ("1" signal) having a pulse width which is longer than eight periods of the clock pulse $\emptyset_1$. The initial clear signal IC is applied to a terminal $T_5$ of the address data generating circuit 50 via OR gates 87 and 88 (FIG. 4) and also to the terminal $T_3$ of the envelope generator 58 via an OR gate 87. This initial clear signal IC is also applied to terminal $T_4$ of the envelope generator 58. When the initial clear signal IC ("1" signal) is applied to the terminal $T_5$ of the address data generating circuit 50, the inverter 55 (FIG. 6) outputs "0" signal to the enabling terminal EN of the gate circuit 53. As a result, the gate circuit 53 is closed and therefore the output of the gate circuit 53 is rendered "0", so that all of the stages of the shift register 54 are cleared. When the initial clear signal IC is applied to the terminal $T_3$ of the envelope generator 58, the inverter 90 outputs "0" signal to one input terminal of an AND gate 91, so that the AND gate 91 outputs "0" signal to the input terminal of the OR gate 92. At this time, "0" signal is being supplied from the comparator 57 (FIG. 4) to the input terminal of the OR gate 92, so that the OR gate 92 outputs "0" signal to the input terminal of the shift register 66. As a result, each stage of the shift register 66 is cleared so that this register outputs "0" signal to the enabling terminal EN of the gate circuit 71 whereupon the gate circuit 71 is closed to output data representative of 0 to the input terminal of the shift register 70. As a result, all of the stages of the shift register 70 are cleared. The "0" signal outputted from the shift register 66 is also applied to the enabling terminal EN of the envelope memory 75 so that this envelope memory is disenabled to output data representative of 0.

When the initial clear signal IC is applied to a terminal $T_4$ of the envelope generator 58, an OR gate 93 outputs "1" signal to the input terminal of the shift register 65, so that data representative of 1 is inputted into each stage of the shift register 65. Therefore, the shift register 65 outputs "1" signal to an input terminal of an inverter 96 of the OR gate circuit 76 via an OR gate 94, so that the inverter 96 outputs "0" signal to one input terminals of OR gates 97. At this time, "0" signal is being applied from the envelope memory 75 to each of the other input terminals of the OR gates 97, so that the OR gate circuit 76 outputs data representative of "0" to the input terminal of the multiplier 80 to render the output thereof "0", which means that no sound is generated by the loud speaker 84.

When the initial clear signal IC is rendered "0", the inverter 90 outputs "1" signal to input terminals of AND gates 95 and 91, so that the data in each stage of the shift register 65 is circulated from its output to its input through the AND gate 95 and the OR gate 93. The same is true with the shift register 66.

On the other hand, when the rhythm switch 62 (FIG. 4) is in the OFF-state, "0" signal is applied to the input terminal of the inverter 99, so that the inverter 99 outputs "1" signal to the terminal $T_5$ of the address data generating circuit 50 through the OR gate 88. As a result, "0" signal is applied to the enabling terminal EN of the gate circuit 53 (FIG. 5) so that the gate circuit 53 outputs data representative of 0 to the shift register 54. In other words, when the rhythm switch 62 is in the OFF-state, each stage of the shift register 54 is cleared.

When the rhythm switch 62 is turned on, one of the eight kinds of rhythm pulses selected by the output of the rhythm selector 61 is generated in the rhythm pattern generating circuit 60 and is outputted in a time-sharing manner in accordance with the channel signal CH.

Figure 9:
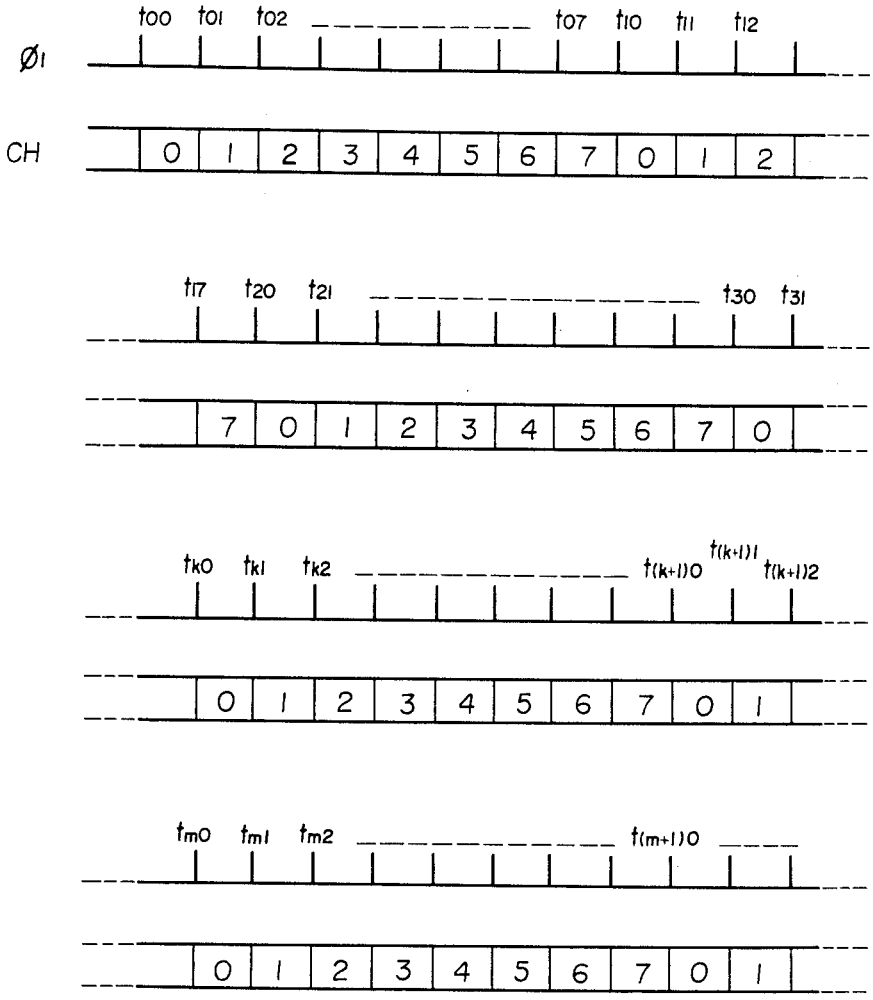
FIG. 9 is a timing chart for a clock pulse $\emptyset_1$ and a channel signal used in the system of FIG. 4.

In a timing chart shown in FIG. 9, when the channel counter 41 outputs the channel signal CH representative of 0 at time $t_{00}$, the rhythm pattern generating circuit 60 outputs rhythm pulses representative of a maracas tone. If this rhythm pulse is "0" signal during a time period between time $t_{00}$ and time $t_{01}$, the maracas tone is not formed. On the other hand, if the rhythm pulse is "1" signal during this time period, the maracas tone is formed in the following manner.

When the rhythm pattern generating circuit 60 outputs "1" signal during the time period between time $t_{00}$ and time $t_{01}$, the "1" signal is applied to the terminal $T_5$ of the address data generating circuit 50 via the OR gates 87 and 88 and also to the terminal $T_3$ of the envelope generator 58 via the OR gate 87. When the "1" signal is applied to the terminal $T_5$ of the address data generating circuit 50, the inverter 55 (FIG. 6) outputs "0" signal to the gate circuit 53, so that the gate circuit 53 outputs data representative of 0 to the input terminal of the shift register 54. This data is loaded onto the shift register 54 by the clock pulse at time $t_{01}$, so that the loaded data is outputted from the shift register 54 at a time period between time $t_{10}$ and time $t_{11}$ when the channel signal CH is in the state of "0". This output data representative of 0 is applied to the input terminal of the adder 51 and also to the input terminal of the adder 48 (FIG. 4) as the address data ADDa. At this time, the channel signal CH represents 0, and therefore the starting address memory 47 outputs data, representing the starting address STAD of the area 40*a* of the waveform storage means 40, to the other input terminal of the adder 48, this area 40*a* storing the waveform data representing the maracas tone. Therefore, when the data representative of 0 is applied to the input terminal of the adder 48, the data, representing the starting address STAD of the maracas tone area 40*a*, is outputted as address data ADD from the adder 48 to the address terminal AT of the waveform storage means 40, so that a first one of the waveform data representing the respective maracas tone waveforms is outputted from the waveform storage means 40 to the one input terminal of the multiplier 80.

When the data representative of 0 is applied to the input terminal of the adder 51 (FIG. 6) during a time period between time $t_{10}$ and time $t_{11}$, the adder 51 outputs data representative of 1 to the input terminal B of the selector 52. At this time, "0" signal is being supplied from the comparator 43 to the selector terminal SA of the selector 52, so that the data representing 1 and applied to the input terminal B is outputted from the selector 52 to the input terminal of the gate circuit 53. At this time, "0" signal is being supplied to the terminal $T_5$ of the address data generating circuit 50 (FIG. 6), and "1" signal is being supplied to the enabling terminal EN of the gate circuit 53. Therefore, the gate circuit 53 is in the open state, so that the data representative of 1 and outputted from the selector 52 is applied to the input terminal of the shift register 54. Then, this data representing 1 is loaded onto the shift register 54 by the clock pulse $\emptyset_1$ generated at time $t_{11}$ and then is outputted from the shift register 54 during a time period between time $t_{20}$ and time $t_{21}$. At this time, the starting address memory 47 is outputting the data representing the starting address STAD of the maracas tone area 40*a*. Therefore, when the shift register 54 outputs the data representative of 1, the adder 48 outputs address data ADD, representing the sum of the starting address of the maracas tone area 41*a* and 1, to the waveform storage means 40, so that a second one of the waveform data representing the respective maracas tone waveforms is read from the waveform storage means 40.

When the shift register 54 outputs data representing 1, the output data from the adder 51 represents 2. This output data 2 is applied through the selector 52 and the gate circuit 53 to the input terminal of the shift register 54 and is loaded onto it by the clock pulse $\emptyset_1$ generated at time $t_{21}$. Then, this data 2 is outputted from the shift register 54 during a time period between time $t_{30}$ to time $t_{31}$ when the channel signal CH is 0.

Then, in a similar manner, each time the channel signal CH is rendered 0, the other waveform data representing the maracas tone waveforms are sequentially read from, the waveform storage means 40, these readout waveform data being applied to the multiplier 80. Then, it is assumed that the shift register 54 outputs data identical to data representative of the relative repeat address of the maracas tone during a time period between time $t_{k0}$ and time $t_{k1}$. At this time, the repeat address memory 46 outputs data representative of the relative repeat address RPADa of the maracas tone. Therefore, during the time period between time $t_{k0}$ and time $t_{k1}$, the data applied respectively to the terminals A and B of the comparator 57 coincide with each other, so that this comparator outputs the coincidence signal $EQ_2$ ("1" signal) to the terminal $T_2$ of the envelope generator 58. The coincidence signal $EQ_2$ will be described later.

Then, the data representing the waveforms of the maracas tone are sequentially read from the waveform storage means 40. It is assumed that the shift register 54 outputs data equal to data representing the relative end address of the maracas tone during a time period between time $t_{m0}$ and time $t_{m1}$ when the channel signal represents 0. At this time, the end address memory 42 outputs data representing the relative end address ENADa of the maracas tone. Therefore, the data applied respectively to the input terminals A and B of the comparator 43 coincide with each other, so that this comparator 43 outputs the coincidence signal $EQ_1$ ("1" signal) to the terminal SA of the selector 52 (FIG. 6). When the coincidence signal $EQ_1$ is applied to the terminal SA of the selector 52 during the time period between time $t_{m0}$ and time $t_{m1}$, the output (the repeat data RPD) applied from the adder 45 to the input terminal A of the selector 52 is outputted from the selector 52. During the time period between time $t_{m0}$ to time $t_{m1}$ when the channel signal represents 0, the repeat data RPD represents the sum of the relative repeat address of the maracas tone and the random data RD. Therefore, this repeat data RPD is outputted from the selector 52 and applied to the input terminal of the shift register 54 through the gate circuit 53. This repeat data RPD is loaded onto the shift register 54 by the clock pulse $\emptyset_1$ genrated at time $t_{m1}$. Then, during a time period between time $t_{(m+1)0}$ and time $t_{(m+1)1}$ when the channel signal CH represents 0, this repeat data RPD is outputted from the shift register 54. Then, in a similar manner, each time the channel signal CH is rendered 0, the waveform data representing the maracas tone waveforms (the portion B shown in FIGS. 2A and 2B) are sequentially read from the waveform storage means 40. And, when the shift register 54 again outputs data identical to the data representing the relative end address of the maracas tone, the repeat data RPD is again loaded onto the shift register 54. Then, this operation is repeated.

During the time period between time $t_{00}$ and time $t_{01}$, the rhythm pattern generating circuit 60 generates "1" signal which is fed to the terminal $T_3$ of the envelope generator 58 via the OR gate 87 whereupon the output from the inverter 90 (FIG. 7) is rendered 0, so that the outputs from the AND gates 95 and 91 are both rendered 0. At this time, the initial clear signal IC and the coincidence signal $EQ_2$ are both in the state of "0", so that the OR gates 93 and 92 output "0" signals to the input terminals of the shift registers 65 and 66, respectively. These "0" signals are loaded onto the shift registers 65 and 66, respectively, by the clock pulse $\emptyset_1$ generated at time $t_{01}$, and are outputted respectively from the shift registers 65 and 66 during the time period between time $t_{10}$ and time $t_{11}$. When the shift registers 65 and 66 output "0" signals, respectively, the OR gate 94 outputs "0" signal, so that the inverter 96 outputs "1" signal. As a result, the OR gate circuit 76 outputs data representative of "11 . . . 11" (=1) to the input terminal of the multiplier 80 via the terminal $T_1$. At this time, as described above, the first waveform data representative of the waveform of the maracas tone is being applied to the input terminal of the multiplier 80. Therefore, when the data representative of "1" is applied to the input terminal of the multiplier 80, this multiplier outputs data, representative of (the first maracas tone waveform data × "1") to the accumulator 81. Thereafter, each time the channel signal CH is rendered 0, the shift registers 65 and 66 outputs "0" signals, respectively. Therefore, each time the channel signal CH is rendered 0, the multiplier 80 outputs data representative of (the maracas tone waveform data × "1") to the accumulator 81.

Then, when the comparator 57 outputs the coincidence signal $EQ_2$ ("1" signal) to the one input terminal of the OR gate 92 (FIG. 7) during a time period between time $t_{k0}$ and time $t_{k1}$, the OR gate 92 outputs "1" signal to the input terminal of the shift register 66. This "1" signal is loaded onto the shift register 66 by the clock pulse $\emptyset_1$ applied to the shift register 66 at time $t_{k1}$, and is outputted from the shift register 66 during a time period between time $t_{(k+1)0}$ and time $t_{(k+1)1}$ when the channel signal CH represents 0. Thereafter, each time the channel signal CH is rendered 0, the shift register 66 outputs "1" signal. This "1" signal outputted from the shift register 66 is fed to the input terminal of the inverter 96 via the OR gate 94 whereupon the inverter 96 outputs "0" signal. Also, the "1" signal from the shift register 66 is applied to the enabling terminal EN of each of the gate circuit 71 and the envelope memory 75 whereupon the gate circuit 71 goes to the open state while the envelope memory 75 goes to the enabling state. At this time, the shift register 70 is outputting data representative of 0 to the address terminal $AT_1$ of the envelope memory 75. The data in the shift register 70 is changed after this time, as later described. Also, at this time, the channel signal CH representative of 0 is being applied to the address terminal $AT_2$ of the envelope memory 75. Therefore, when the envelope memory 75 goes to the enabling state during a time period between time $t_{(k+1)0}$ and time $t_{(k+1)1}$, the first envelope data ED representative of the maracas tone is read from the area 75*a* of the envelope memory 75 and applied to the other input terminal of the multiplier 80 via the OR gate circuit 76 and the terminal $T_1$.

The data representative of 0 and outputted from the shift register 70 is applied to the other input terminal of the adder 69. During this time period between time $t_{(k+1)0}$ and time $t_{(k+1)1}$, the output of the end address detecting circuit 72 is "0" signal, and therefore the inverter 73 is outputting "1" signal to the enabling terminal EN of the oscillator 68, so that the pulse signal generated by the oscillator 68 is being applied to the one input terminal of the adder 69. When the output pulse signal of the oscillator 68 is "0" signal during the time period between time $t_{(k+1)0}$ and time $t_{(k+1)1}$, the output data of the adder 69 is 0. This output data is applied to the input terminal of the shift register 70 via the gate circuit 71 and is loaded onto the shift register 70 by the clock pulse $\emptyset_1$ applied thereto at time $t_{(k+1)1}$. This loaded data is outputted from the shift register 70 during the time period between time $t(k+2)0$ and time $t_{(k+2)1}$ when the channel signal CH represents 0. During this time period between time $t_{(k+2)0}$ and time $t_{(k+2)1}$, the output of the shift register 66 is 1 signal and therefore in the manner described above, the first envelope data ED representative of the maracas tone is read from the envelope memory 75 and is applied to the multiplier 80. Thereafter, until the output pulse signal of the oscillator 68 goes to the "1" state, the above-mentioned operation is repeated when the channel signal CH is 0.

Then, when the output pulse signal of the oscillator 68 goes to the "1" state, the adder 69 adds "1" to the output of the shift register 70 representative of "0". This addition result data representing 1 is applied via the gate circuit 71 to the input terminal of the shift register 70 and is loaded onto it. Thereafter, each time the channel signal CH is rendered 0, the shift register 70 outputs data representative of 1, so that the second envelope data ED representative of the maracas tone is read from the envelope memory 75 and applied to the multiplier 80. Then, when the output of the oscillator 68 again goes to the "1" state, data representative of 2 is outputted from the adder 69 and is loaded onto the shift register 70. Thereafter, when the channel signal CH is 0, the third envelope data ED representative of the maracas tone is read from the envelope memory 75 and is applied to the multiplier 80. Then, the above operation is repeated.

As described above, the envelope generator 58 is so constructed that when the channel signal CH is "0", the envelope data ED representative of the maracas tone are sequentially read from the envelope memory 75 at an interval longer than the period of the clock pulse $\emptyset_1$ and are applied to the multiplier 80. The reason for this is that the variation of the envelope does not need to be more complicated and delicate than the variation of the musical tone waveform data.

The output data produced from the shift register 70 when the channel signal CH is 0, is increased gradually, and when the shift register 70 outputs the end address data representative of "11 . . . 11", the end address detecting circuit 72 detects this end address to apply "1" signal to the input terminal of the inverter 73. Therefore, "0" signal is applied to the enabling terminal EN of the oscillator 68, so that "0" signal is outputted from the oscillator 68 to the one terminal of the adder 69, and the data representative of "11 . . . 11" is applied to the input terminal of the shift register 70. Thereafter, each time the channel signal CH is rendered 0, the shift register 70 outputs the data representative of "11 . . . 11", so that the data representative of 0 is read from the end address of the area 75*a* of the envelope memory 75 and is applied to the multiplier 80. This condition is maintained until the rhythm pattern generating circuit 60 outputs the next "1" signal when the channel signal CH is 0, that is to say, until the rhythm pattern generating circuit 60 outputs the next rhythm pulse ("1" signal) of the maracas tone.

Thus, the rhythm pattern generating circuit 60 outputs "1" signal when the channel signal CH is 0, and this "1" signal is applied to the terminal $T_3$ of the envelope generator 58, so that the envelope generator 58 outputs the data representative of "11 . . . 11" to the other input terminal of the multiplier 80. This condition is maintained until the comparator 57 outputs the coincidence signal $EQ_2$ ("1" signal). During this period, the data representative of the attack portion A (FIG. 2) of the waveform of the maracas tone are read from the waveform storage means 40 and are sequentially applied to the multiplier 80. When the comparator 57 outputs the coincidence signal $EQ_2$, the envelope data ED representative of the maracas tone are read from the envelope memory 75 at a cycle greater than the cycle of the clock pulse $\emptyset_1$ and are sequentially applied to the multiplier 80. During this period, the data representative of the portion B (FIGS. 2A and 2B) of the waveform of the maracas tone is repeatedly read from the waveform storage means 40 and is applied to the multiplier 80. The first address (the repeat address) of the area of the storage means 40 storing the data representative of the portion B is modified or varied by the random data RD each time the data representative of the portion B is repeatedly read from the waveform storage means 40. When the data representative of 0 stored in the end address of the area 75*a* of the envelope memory 75 is read therefrom, this data is successively applied to the multiplier 80. It will be appreciated that when this data is being applied to the multiplier 80, the tone generation of the maracas tone is not carried out.

The foregoing is the operation of the circuit shown in FIG. 4 when the channel signal CH is 0. A similar operation is carried out when the channel signal CH represents any one of 1 to 7. Therefore, for example, when the channel signal CH represents 1, the data representative of waveform of conga tone (high) is outputted from the multiplier 80, and when the channel signal CH represents 2, the data representative of the waveform of conga tone (low) is outputted, and when the channel signal CH represents 7, the data representative of the waveform of the cymbal tone (No.2) is outputted. The waveform data outputted from the multiplier 80 are accumulated by the accumulator 81, and the output data of the accumulator 81 is converted into an analogue signal by the digital-to-analogue converter 82, so that this analogue signal is applied to the speaker via the amplifier 84.

What is claimed is:

1. A musical tone forming system comprising:

(a) waveform storage means for storing data representative of an attack portion of a musical tone waveform of a percussion instrument and data representative of part of the portion of said musical tone waveform following said attack portion, said data representative of said part being stored at consecutive storage locations beginning at a certain repeat address;

(b) random data generating means for generating random data varying with time;

(c) address calculation means for calculating random repeat starting addresses by combining said certain repeat address with said generated random data; and (d) address means for addressing said waveform storage means to first read the data representative of said attack portion and to then repeatedly read said part from said waveform storage means to thereby form a musical tone signal of said percussion instrument, said addressing means carrying out every repeated reading of said part in one scan direction only, and beginning the scan on each repeated reading from a respective random repeat starting address provided by said address calculation means.

2. A musical tone forming system according to claim 1, further comprising means for imparting an amplitude envelope to said part of the musical tone waveform read from said waveform storage means.

3. A musical tone forming system according to claim 1 further comprising:

keyboard means having a plurality of keys; and frequency signal generating means for generating frequency signal corresponding to the frequency of a depressed key among said keys, said address means addressing said waveform means at the rate corresponding to said frequency signal.

4. A musical tone forming system according to claim 1 further comprising:

rhythm selecting means for selecting a rhythm among a plurality of rhythms; and rhythm pattern generating means for generating a rhythm pattern corresponding to the selected rhythm, said address means addressing said waveform memory in response to said rhythm pattern signal.

* * * * *